US007753104B2

(12) United States Patent
Luczak et al.

(10) Patent No.: US 7,753,104 B2
(45) Date of Patent: Jul. 13, 2010

(54) INVESTMENT CASTING CORES AND METHODS

(75) Inventors: Blake J. Luczak, Manchester, CT (US); Eric A. Hudson, Harwinton, CT (US); James T. Beals, West Hartford, CT (US); Eric L. Couch, South Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 862 days.

(21) Appl. No.: 11/582,592

(22) Filed: Oct. 18, 2006

(65) Prior Publication Data

US 2010/0116452 A1 May 13, 2010

(51) Int. Cl.
*B22C 9/10* (2006.01)
*B22C 9/04* (2006.01)
*B22C 7/02* (2006.01)

(52) U.S. Cl. ..... 164/516; 164/28; 164/369; 164/35; 164/45; 164/235; 164/361

(58) Field of Classification Search ..... 164/516, 164/28, 369, 35, 45, 235, 361
See application file for complete search history.

(56) References Cited

U.S. PATENT DOCUMENTS

| | | | |
|---|---|---|---|
| 5,296,308 | A | 3/1994 | Caccavale et al. |
| 6,637,500 | B2 | 10/2003 | Shah et al. |
| 6,929,054 | B2 | 8/2005 | Beals et al. |
| 7,216,689 | B2 | 5/2007 | Verner et al. |
| 7,270,173 | B2 | 9/2007 | Wiedemer et al. |
| 2005/0274478 | A1 * | 12/2005 | Verner et al. ..... 164/45 |

FOREIGN PATENT DOCUMENTS

| | | | |
|---|---|---|---|
| WO | 00/78480 | A1 | 12/2000 |

* cited by examiner

*Primary Examiner*—Kevin P Kerns
(74) *Attorney, Agent, or Firm*—Bachman & LaPointe, P.C.

(57) ABSTRACT

A method involves forming a core assembly. The forming includes molding a first ceramic core over a first refractory metal core to form a core subassembly. The subassembly is assembled to a second ceramic core.

20 Claims, 9 Drawing Sheets

INVESTMENT CASTING CORES AND METHODS

BACKGROUND OF THE INVENTION

The invention relates to investment casting. More particularly, it relates to the investment casting of superalloy turbine engine components.

Investment casting is a commonly used technique for forming metallic components having complex geometries, especially hollow components, and is used in the fabrication of superalloy gas turbine engine components. The invention is described in respect to the production of particular superalloy castings, however it is understood that the invention is not so limited.

Gas turbine engines are widely used in aircraft propulsion, electric power generation, and ship propulsion. In gas turbine engine applications, efficiency is a prime objective. Improved gas turbine engine efficiency can be obtained by operating at higher temperatures, however current operating temperatures in the turbine section exceed the melting points of the superalloy materials used in turbine components. Consequently, it is a general practice to provide air cooling. Cooling is provided by flowing relatively cool air from the compressor section of the engine through passages in the turbine components to be cooled. Such cooling comes with an associated cost in engine efficiency. Consequently, there is a strong desire to provide enhanced specific cooling, maximizing the amount of cooling benefit obtained from a given amount of cooling air. This may be obtained by the use of fine, precisely located, cooling passageway sections.

The cooling passageway sections may be cast over casting cores. Ceramic casting cores may be formed by molding a mixture of ceramic powder and binder material by injecting the mixture into hardened steel dies. After removal from the dies, the green cores are thermally post-processed to remove the binder and fired to sinter the ceramic powder together. The trend toward finer cooling features has taxed core manufacturing techniques. The fine features may be difficult to manufacture and/or, once manufactured, may prove fragile. Commonly-assigned U.S. Pat. Nos. 6,637,500 of Shah et al. and 6,929,054 of Beals et al (the disclosures of which are incorporated by reference herein as if set forth at length) disclose use of ceramic and refractory metal core combinations.

SUMMARY OF THE INVENTION

One aspect of the invention involves a method wherein a core assembly is formed. The forming includes molding a first ceramic core over a first refractory metal core to form a core subassembly. The subassembly is assembled to a second ceramic core.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
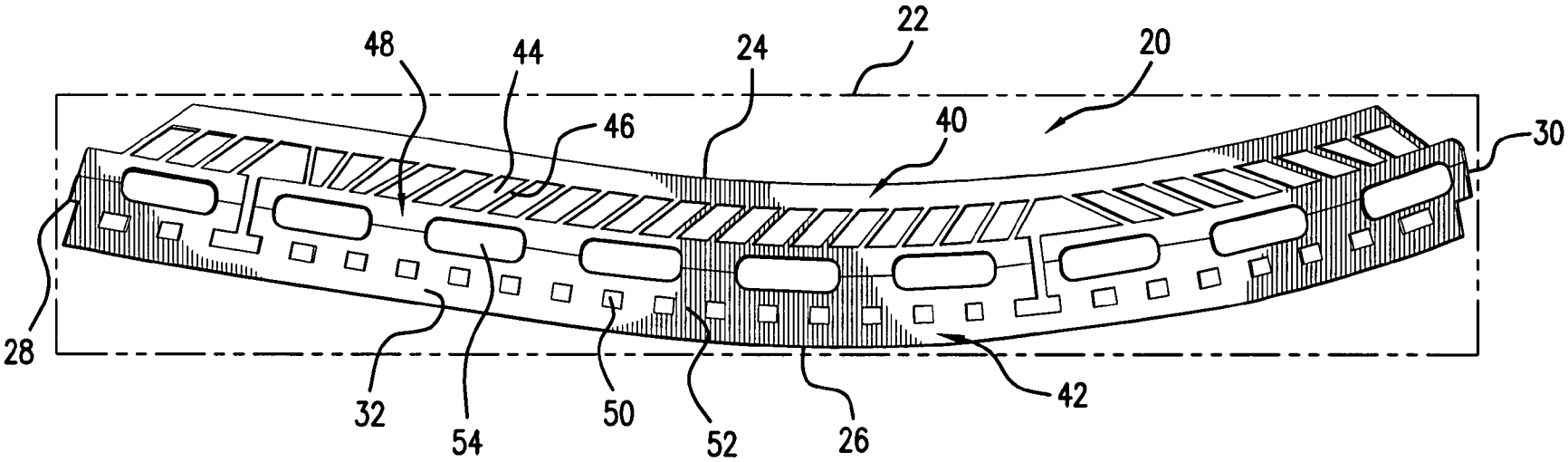
FIG. 1 is a first view of a refractory metal core (RMC).
Figure 2:
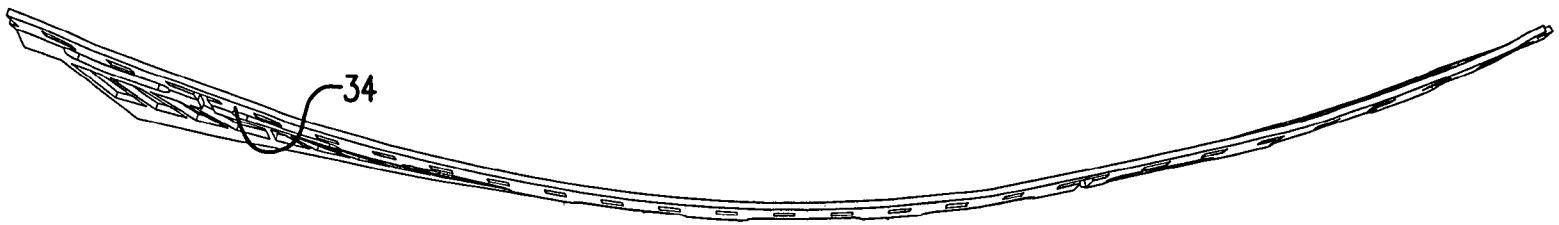
FIG. 2 is a second view of the RMC of FIG. 1.

FIG. 1 shows an exemplary refractory metal core (RMC) 20. The exemplary RMC 20 is used to form leading edge cooling outlet holes on the airfoil of a gas turbine engine vane. The RMC 20 may be cut from a blank or precursor 22 such as a refractory metal sheet strip. The exemplary RMC 20 is cut to be arcuate in planform having a concave leading edge 24 and a convex trailing edge 26. The RMC 20 has a first end 28 and a second end 30. The RMC 20 has a first face 32 and a second face 34 (FIG. 2). FIG. 2 also shows the exemplary RMC as being bowed from end-to-end so that the first surface 32 is generally concave and the second surface 34 is generally convex.

The exemplary RMC 20 has an intact leading portion 40 extending aft/downstream from the leading edge 24. The exemplary RMC 20 has an intact trailing portion 42 extending forward/upstream from the trailing edge 26.

A spanwise array of apertures 44 are located aft/downstream of the leading portion 40 and are separated by a corresponding array of legs 46. Upstream ends of the legs 46 merge with the intact portion 40. Downstream ends of the legs 46 merge with an intermediate portion 48. The exemplary legs 46 are of relatively high length to width ratio and high length to thickness ratio. The exemplary width of the legs 46 is also smaller than the width of adjacent apertures 44.

A spanwise array of apertures 50 is located forward/upstream of the trailing portion 42. The apertures 50 are separated by relatively short and wide legs 52 (e.g., also shorter and wider in actual size than the legs 46).

In the exemplary RMC 20, a spanwise array of apertures 54 extends along the intermediate portion 48.

As is discussed in further detail below, the legs 46 function to cast cooling air outlets. The exemplary apertures 54 serve to secure an overmolded ceramic core 60 (FIG. 3) for casting a leading edge cavity (e.g., an impingement cavity) of the vane airfoil. The exemplary legs 52 are positioned to cast feed passageways (e.g., impingement passageways) for feeding the leading edge cavity (e.g., from a feed passageway).

Figure 3:
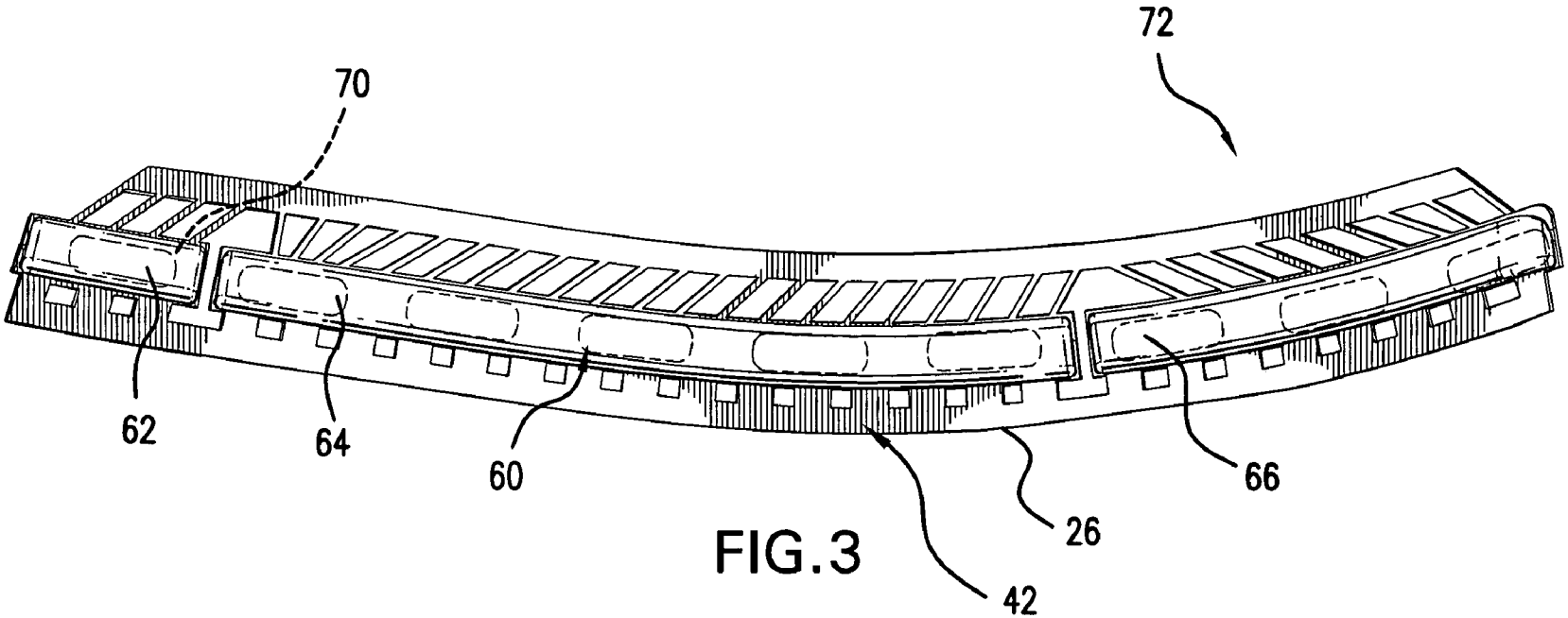
FIG. 3 is a first view of the RMC of FIG. 1 with an overmolded ceramic core to form a core subassembly.
Figure 4:
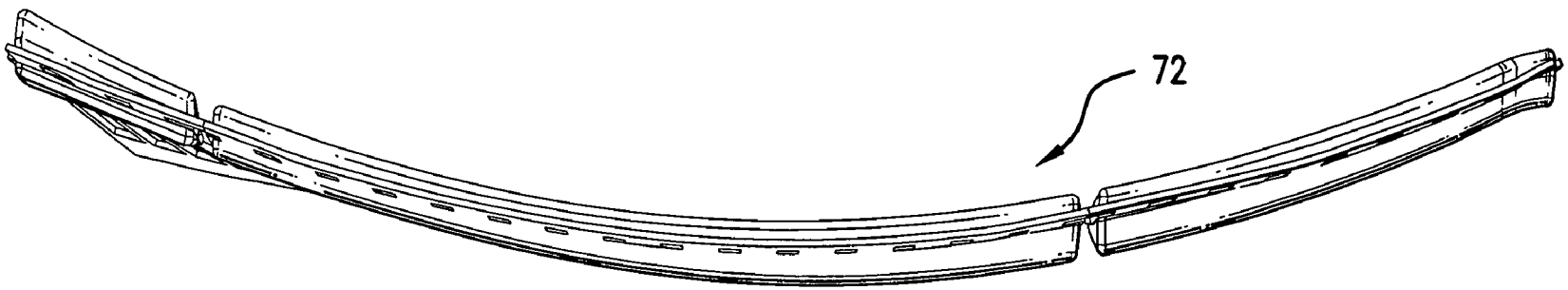
FIG. 4 is a second view of the core subassembly of FIG. 3.

FIGS. 3 and 4 show the leading edge core 60 as formed in three spanwise segments 62, 64, and 66. Each exemplary segment includes portions along both faces of the RMC and connected by posts 70 extending through the apertures 54. The RMC 20 and overmolded core 60 form a core subassembly 72.

Figure 5:
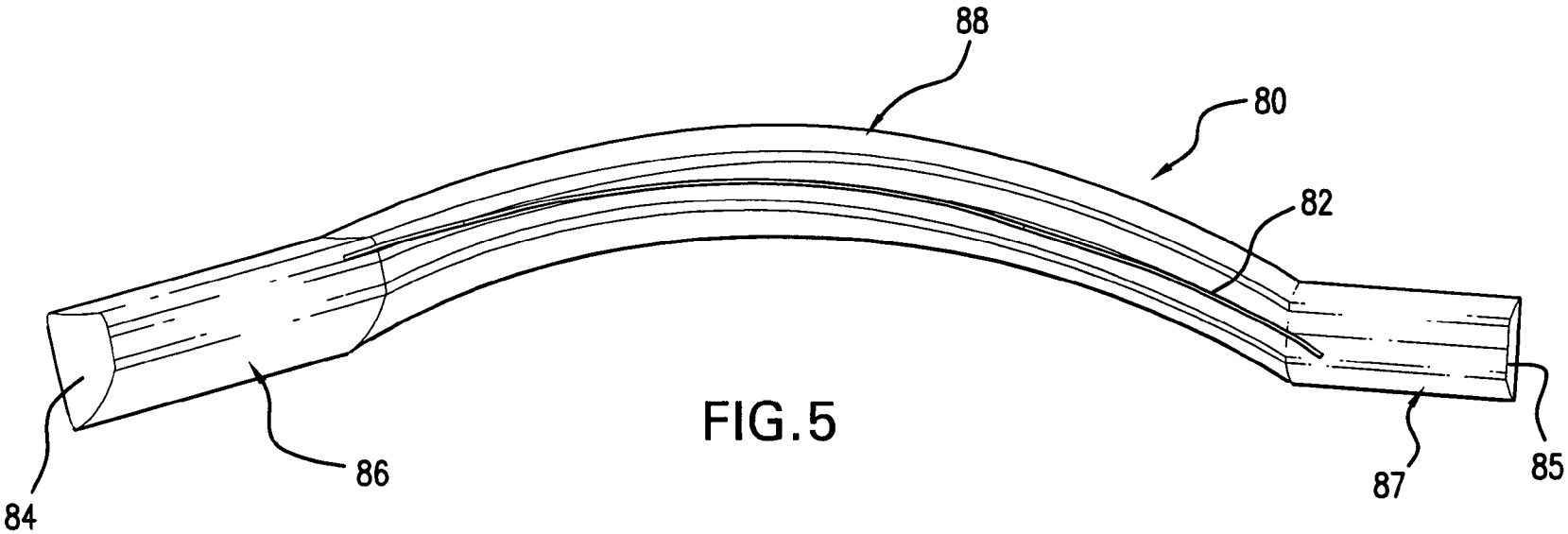
FIG. 5 is a view of a feedcore.
Figure 6:
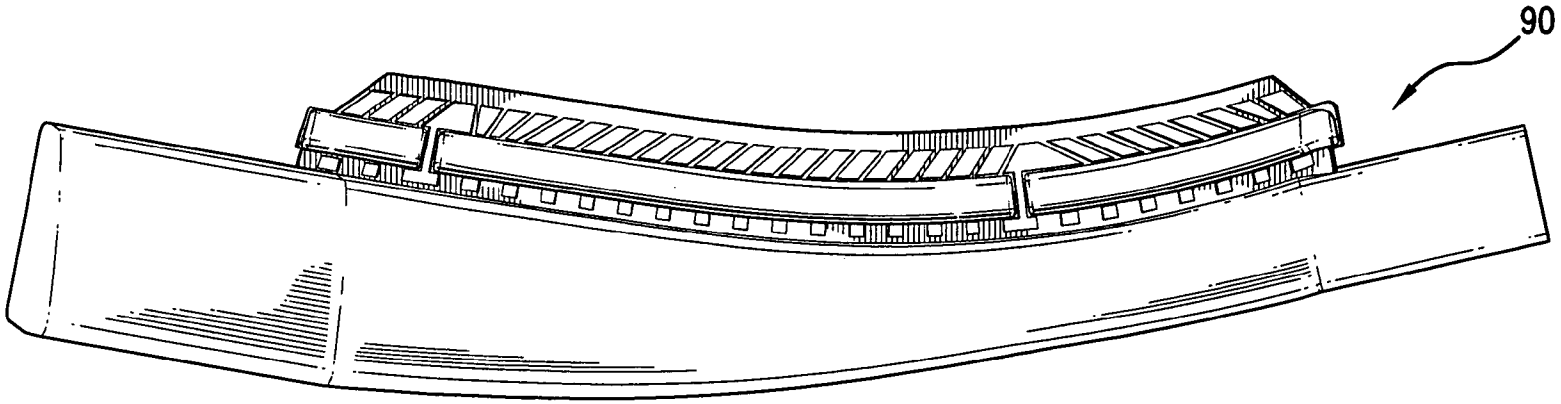
FIG. 6 is a view of a core assembly including the feedcore of FIG. 5 and the core subassembly of FIG. 3.

FIG. 5 shows a ceramic feedcore 80 for forming the feed passageway. The exemplary feedcore 80 is pre-formed with a slot 82 dimensioned and shaped to receive the core trailing portion 42 and trailing edge 26 (FIG. 3). FIG. 6 shows the RMC 20 and overmolded core 60 assembled to the feedcore 80 to form a composite core assembly 90. The exemplary feedcore 80 has first and second ends 84 and 85 with end portions 86 and 87 extending inward therefrom. An arcuate central portion 88 joins the portions 86 and 87 and contains a majority of the exemplary slot 82.

Figure 7:
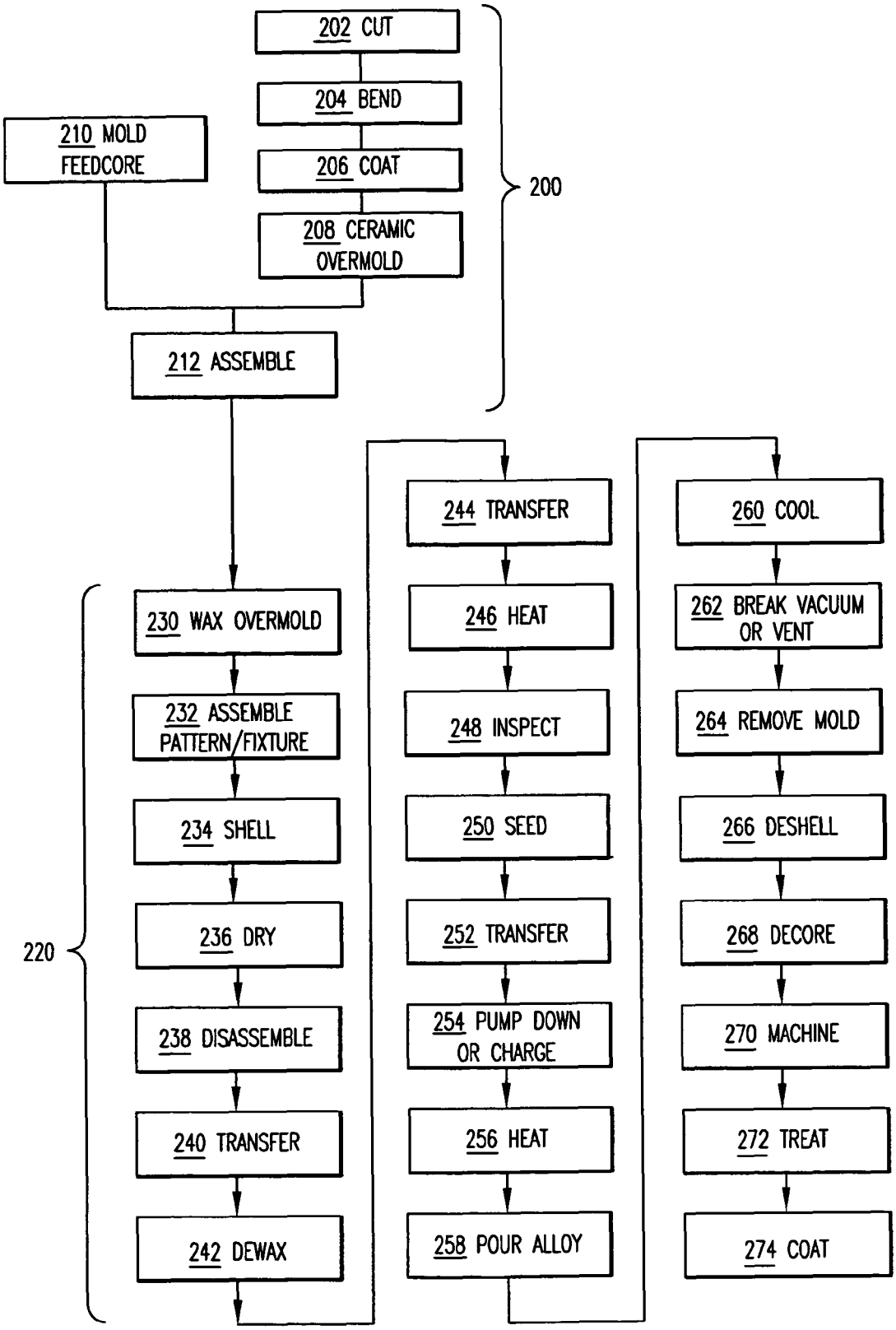
FIG. 7 is a flowchart of an investment casting method.

Steps in the manufacture 200 of the core 20 are broadly identified in the flowchart of FIG. 7 and in the views of FIGS. 1-6. In a cutting operation 202 (e.g., laser cutting, electrodischarge machining (EDM), liquid jet machining, or stamping), a cutting is cut from a blank. The exemplary blank is of a refractory metal-based sheet stock (e.g., molybdenum or niobium) having a thickness in the vicinity of 0.01-0.10 inch between parallel first and second faces and transverse dimensions much greater than that. The exemplary cutting has the cut features of the RMC, but is flat.

In a second step 204, the entire cutting is bent to provide the bowed shape. More complex forming procedures are also possible.

The RMC may be coated 206 with a protective coating. Suitable coating materials include silica, alumina, zirconia, chromia, mullite and hafnia. Preferably, the coefficient of thermal expansion (CTE) of the refractory metal and the coating are similar. Coatings may be applied by any appropriate line-of sight or non-line-of sight technique (e.g., chemical or physical vapor deposition (CVD, PVD) methods, plasma spray methods, electrophoresis, and sol gel methods). Individual layers may typically be 0.1 to 1 mil thick. Layers of Pt, other noble metals, Cr, Si, W, and/or Al, or other non-metallic materials may be applied to the metallic core elements for oxidation protection in combination with a ceramic coating for protection from molten metal erosion and dissolution.

The RMC assembly 20 may be assembled in a die and the ceramic core 60 (e.g., silica-, zircon-, or alumina-based) molded thereover 208. An exemplary overmolding 208 is a freeze casting process. Although a conventional molding of a green ceramic followed by a de-bind/fire process may be used, the freeze casting process may have advantages regarding limiting degradation of the RMC and limiting ceramic core shrinkage. The feedcore 80 may be formed by a molding process 210. An exemplary molding 210 is also a freeze casting, although two different methods may readily be used. The slot 82 may be formed in the molding process or may be cut thereafter. The core subassembly may be assembled and secured 212 to the feedcore. An exemplary securing involves using a ceramic adhesive in the slot 82. An exemplary ceramic adhesive is a colloid which may be dried by a microwave process.

Among alternative variations, a single molding process may form both the ceramic core 60 and the feedcore 80, eliminating the assembly and securing steps. Also, the ceramic core 60 and feedcore 80 may be differently formed (e.g., of different materials and/or by different processes). For example, the feedcore 80 may be formed by a conventional green molding and de-bind/firing process even when the ceramic core 60 is freeze cast.

FIG. 7 also shows an exemplary method 220 for investment casting using the composite core assembly. Other methods are possible, including a variety of prior art methods and yet-developed methods. The core assembly is then overmolded 230 with an easily sacrificed material such as a natural or synthetic wax (e.g., via placing the assembly in a mold and molding the wax around it). There may be multiple such assemblies involved in a given mold.

The overmolded core assembly (or group of assemblies) forms a casting pattern with an exterior shape largely corresponding to the exterior shape of the part to be cast. The pattern may then be assembled 232 to a shelling fixture (e.g., via wax welding between end plates of the fixture). The pattern may then be shelled 234 (e.g., via one or more stages of slurry dipping, slurry spraying, or the like). After the shell is built up, it may be dried 236. The drying provides the shell with at least sufficient strength or other physical integrity properties to permit subsequent processing. For example, the shell containing the invested core assembly may be disassembled 238 fully or partially from the shelling fixture and then transferred 240 to a dewaxer (e.g., a steam autoclave). In the dewaxer, a steam dewax process 242 removes a major portion of the wax leaving the core assembly secured within the shell. The shell and core assembly will largely form the ultimate mold. However, the dewax process typically leaves a wax or byproduct hydrocarbon residue on the shell interior and core assembly.

After the dewax, the shell is transferred 244 to a furnace (e.g., containing air or other oxidizing atmosphere) in which it is heated 246 to strengthen the shell and remove any remaining wax residue (e.g., by vaporization) and/or converting hydrocarbon residue to carbon. Oxygen in the atmosphere reacts with the carbon to form carbon dioxide. Removal of the carbon is advantageous to reduce or eliminate the formation of detrimental carbides in the metal casting. Removing carbon offers the additional advantage of reducing the potential for clogging the vacuum pumps used in subsequent stages of operation.

The mold may be removed from the atmospheric furnace, allowed to cool, and inspected 248. The mold may be seeded 250 by placing a metallic seed in the mold to establish the ultimate crystal structure of a directionally solidified (DS) casting or a single-crystal (SX) casting. Nevertheless the present teachings may be applied to other DS and SX casting techniques (e.g., wherein the shell geometry defines a grain selector) or to casting of other microstructures. The mold may be transferred 252 to a casting furnace (e.g., placed atop a chill plate in the furnace). The casting furnace may be pumped down to vacuum 254 or charged with a non-oxidizing atmosphere (e.g., inert gas) to prevent oxidation of the casting alloy. The casting furnace is heated 256 to preheat the mold. This preheating serves two purposes: to further harden and strengthen the shell; and to preheat the shell for the introduction of molten alloy to prevent thermal shock and premature solidification of the alloy.

After preheating and while still under vacuum conditions, the molten alloy is poured 258 into the mold and the mold is allowed to cool to solidify 260 the alloy (e.g., after withdrawal from the furnace hot zone). After solidification, the vacuum may be broken 262 and the chilled mold removed 264 from the casting furnace. The shell may be removed in a deshelling process 266 (e.g., mechanical breaking of the shell).

The core assembly is removed in a decoring process 268 to leave a cast article (e.g., a metallic precursor of the ultimate part). The cast article may be machined 270, chemically and/or thermally treated 272 and coated 274 to form the ultimate part. Some or all of any machining or chemical or thermal treatment may be performed before the decoring.

Figure 9:
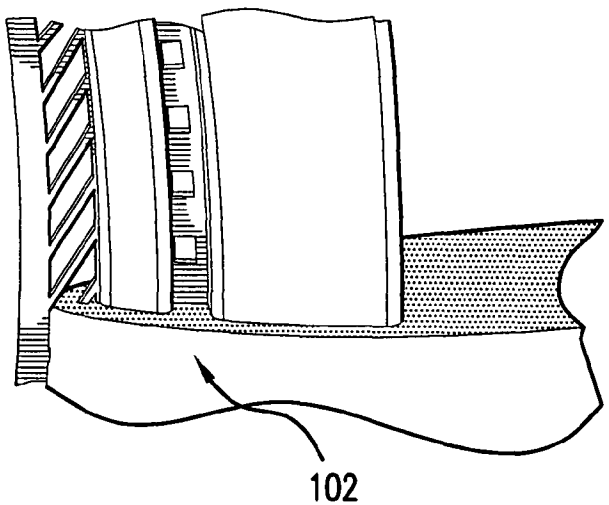
FIG. 9 is a cutaway view of the pattern of FIG. 8.
Figure 8:
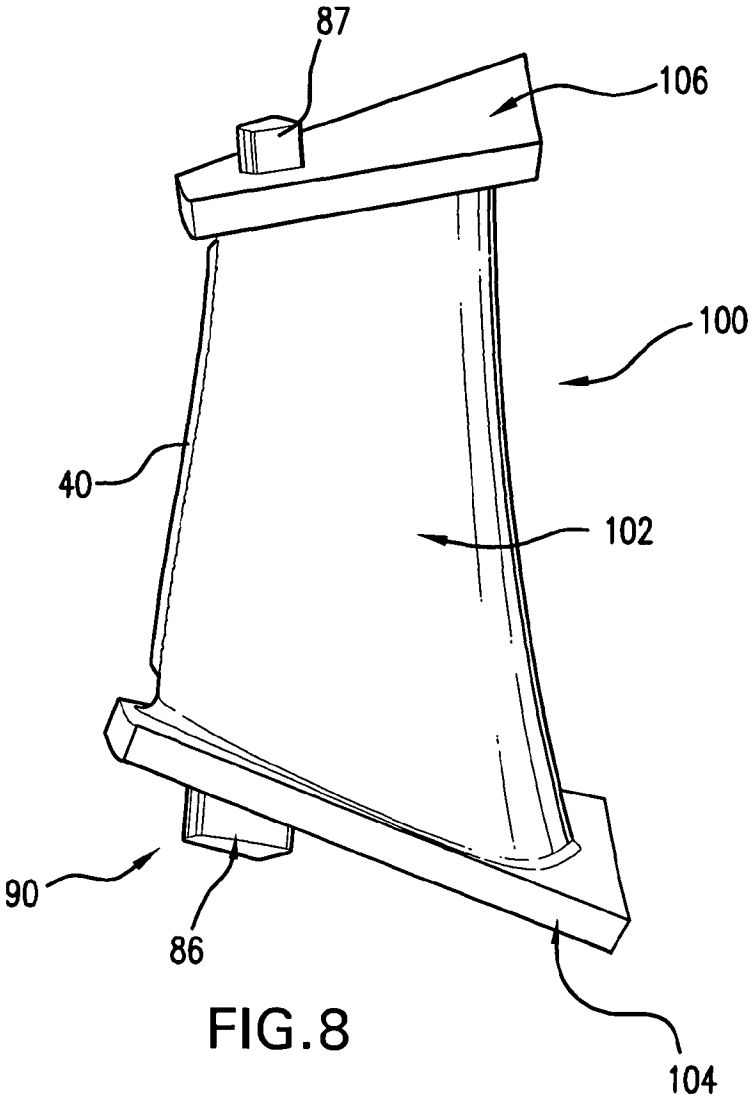
FIG. 8 is a view of an investment casting pattern.

FIGS. 8 and 9 show a pattern 100 formed by the molding of wax over the core assembly 90. The wax includes a portion 102 for forming an airfoil and portions 104 and 106 for forming an outboard shroud and inboard platform. The feedcore end portions 86 and 87 partially protrude from the portions 104 and 106. Similarly, the RMC leading portion 40 protrudes from near the leading edge of the airfoil portion 102.

Figure 11:
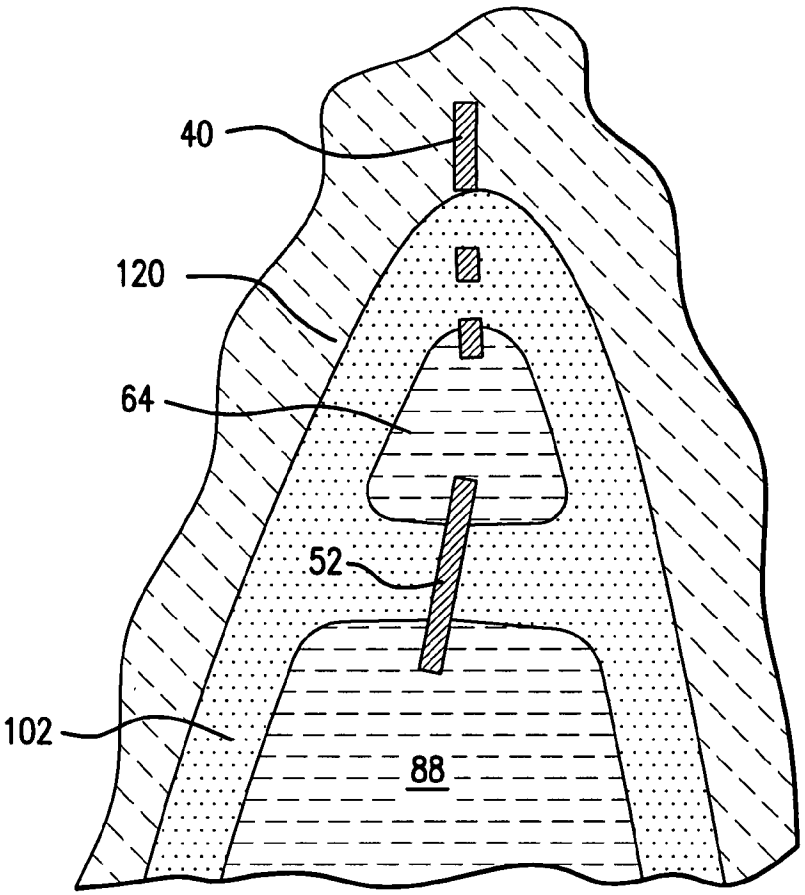
FIG. 11 is a second sectional view of the pattern of FIG. 8 after shelling.
Figure 10:
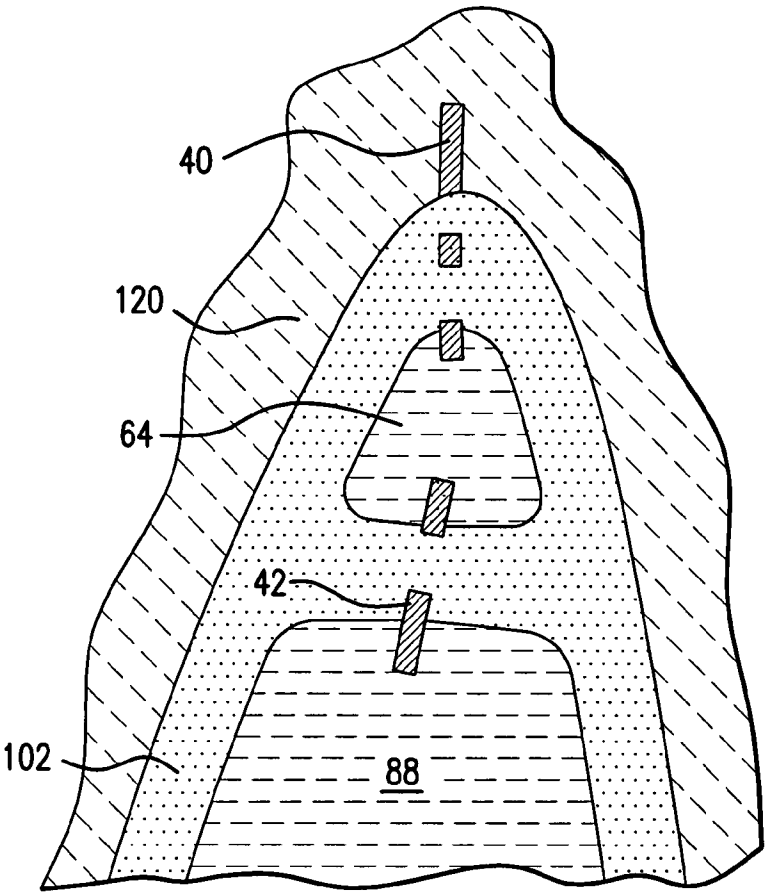
FIG. 10 is a sectional view of the pattern of FIG. 8 after shelling.
Figure 12:
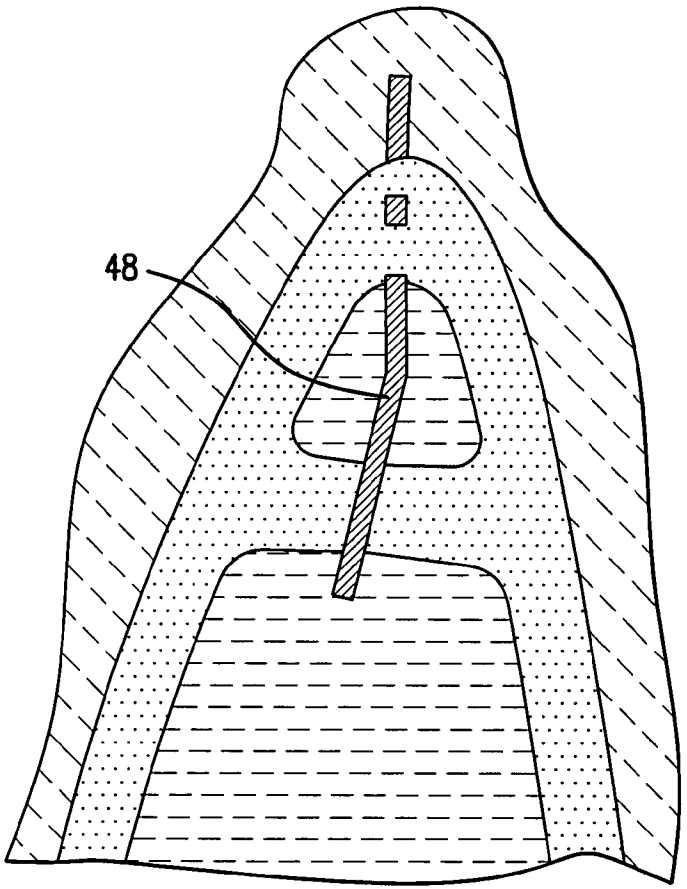
FIG. 12 is a third sectional view of the pattern of FIG. 8 after shelling.

FIGS. 10-12 are sectional views showing the pattern airfoil after shelling with stucco to form the shell 120.

Figure 13:
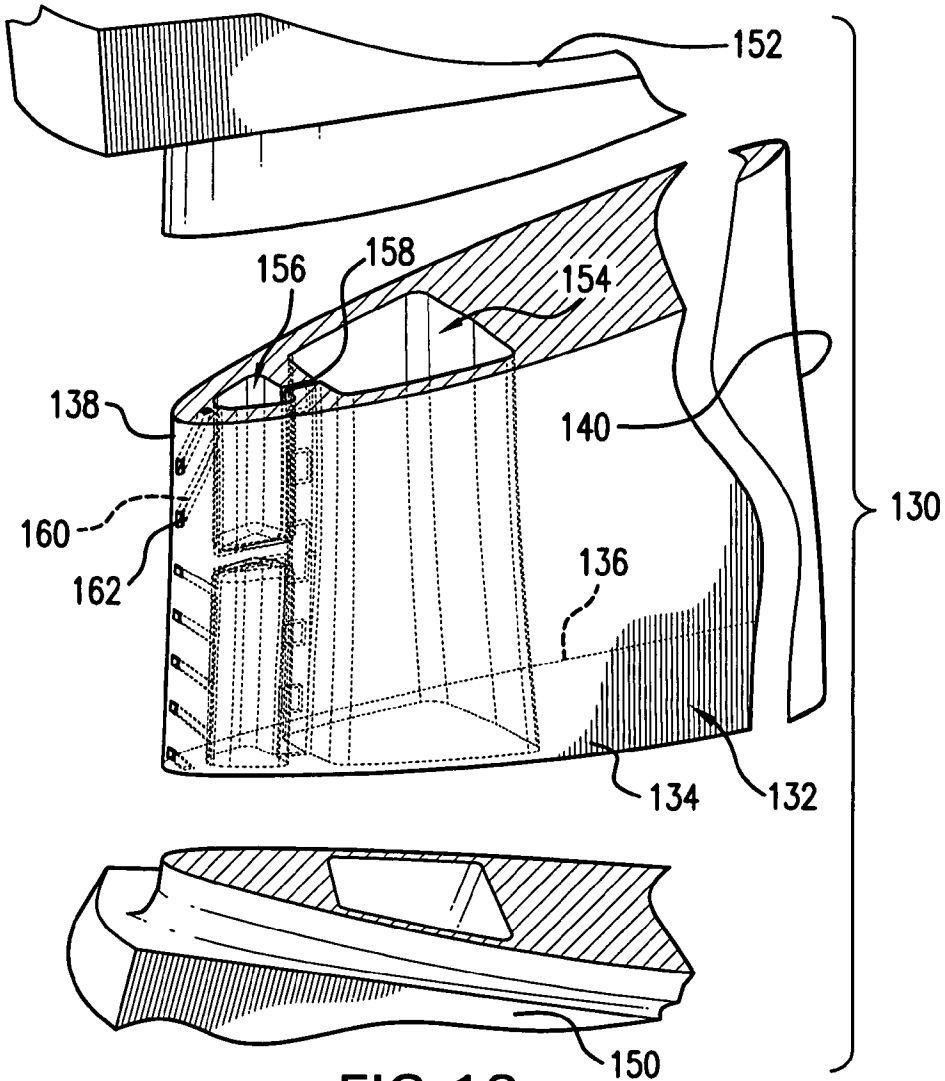
FIG. 13 is a partial cutaway view of a vane cast from the pattern of FIG. 8.

FIG. 13 shows the resulting vane 130 after deshelling and decoring. The vane has an airfoil 132 having a suction side 134 and a pressure side 136 and extending from a leading edge 138 to a trailing edge 140. The airfoil extends between the outboard shroud 150 cast by the pattern shroud portion 104 to an inboard platform 152 cast by the pattern platform portion 106. The feedcore end portions 86 and 87 leave respective ports in the shroud 150 and platform 152. The central portion 88 casts a feed passageway 154. The overmolded core 60 casts a segmented leading edge impingement cavity 156. The legs 52 cast impingement apertures 158 from the feed passageway 154 to the impingement cavity 156. The legs 46 cast outlet passageways 160 from the impingement cavity 156 to outlets 162 along the airfoil outer surface near the leading edge 138.

Figure 14:
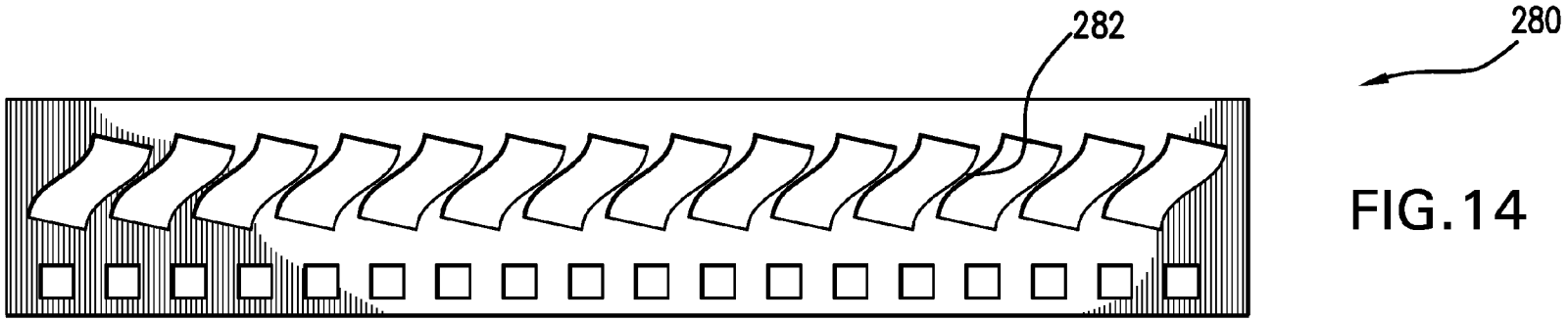
FIG. 14 is a plan view of an alternate RMC precursor.
Figure 15:
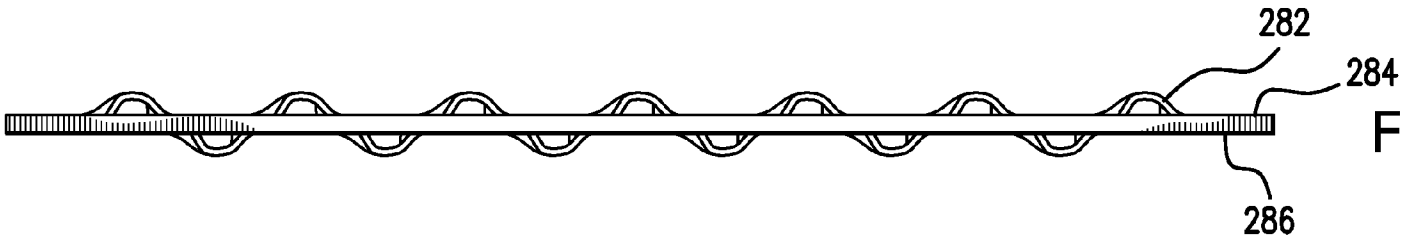
FIG. 15 is an edge view of the precursor of FIG. 14.

FIG. 14 shows an alternate RMC 280 which is cut with a leading array of curved legs 282. The legs 282 might be locally deformed out of parallel with adjacent portions of the RMC 280. In the example of FIG. 15, alternating ones of the legs 282 are deformed outwardly from respective first and second faces 284 and 286 of the RMC 280. Alternatively, all the legs could be deformed in the same direction. Alternatively, each leg may be deformed in both directions (e.g., with an S-contour).

Figure 16:
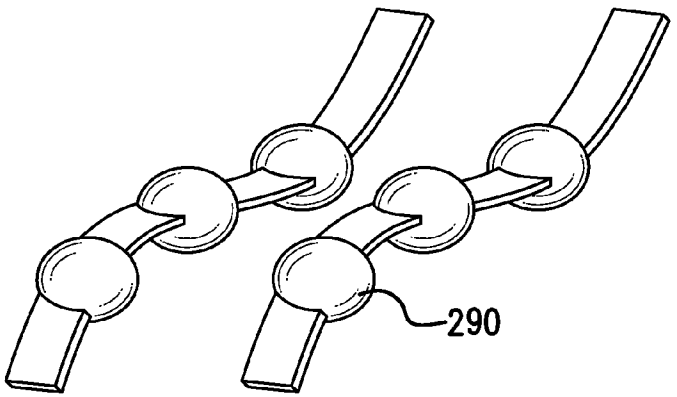
FIG. 16 is a view of legs of an RMC formed from the precursor of FIG. 14.

In a further variation, FIG. 16 shows the legs 282 each overmolded with an associated one or more ceramic protuberances 290. The angling, curvature, and deformation of the legs 282 increase outlet flowpath length to increase the transfer. The protuberances 290 further increase surface area for a given length and may induce turbulence or other flow effects to further increase heat transfer.

Figure 17:
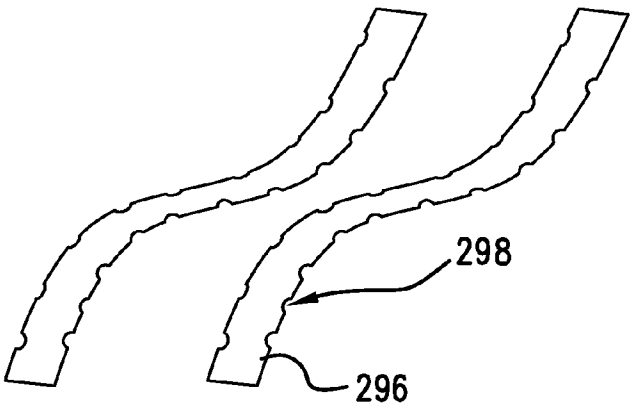
FIG. 17 is a view of alternate RMC legs.

FIG. 17 shows alternate protuberances 296 unitarily formed with (e.g., in the original cutting) the legs by cutting in from sides of the legs to leave protuberances between the cuts 298. The cuts then cast protuberances in the resulting passageways.

An alternative (not shown) would involve forming recesses (e.g., dimples) in the sides of the legs (the faces of the original core blank) rather than forming through-holes. The recesses would, in turn, cast protrusions from the spanwise sides of the outlet passageways.

Figure 18:
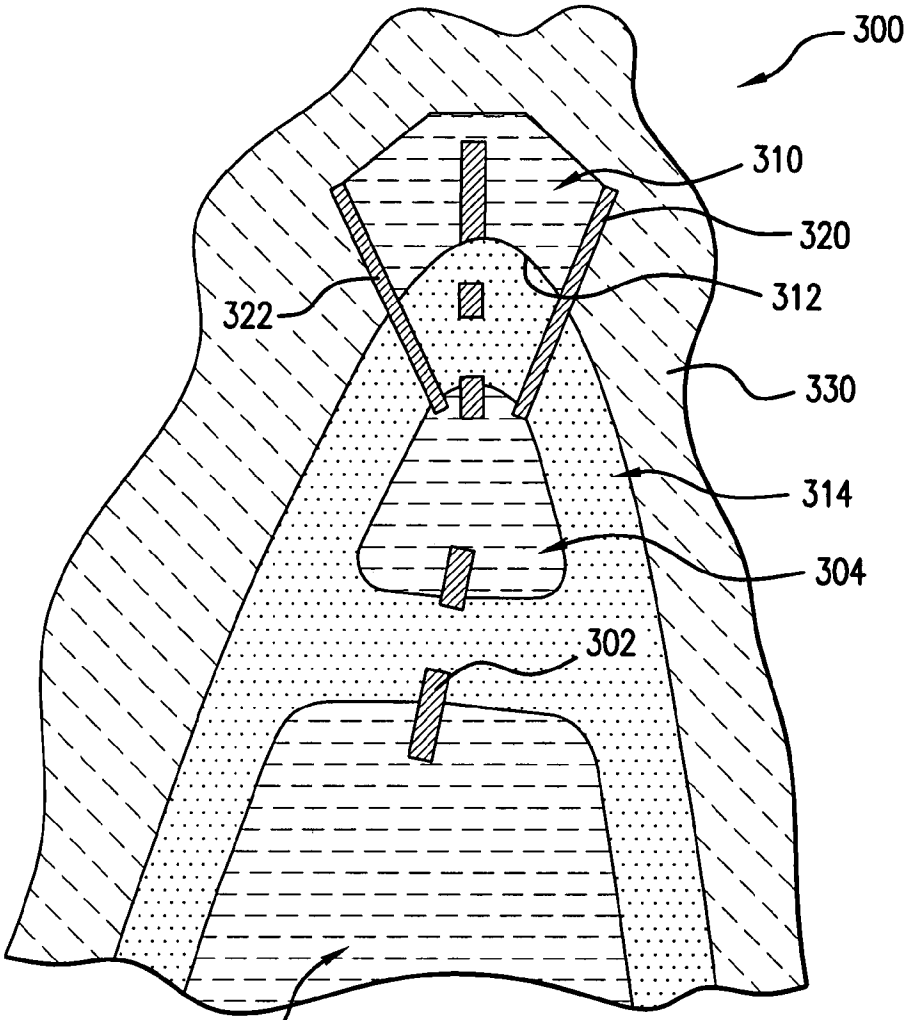
FIG. 18 is a sectional view of an alternate shelled pattern.

FIG. 18 shows an alternate shelled pattern 300. The pattern includes an RMC 302, an impingement cavity core 304, and a feedcore 306, which may be similar to the RMC 20, impingement cavity core 60, and feedcore 80. In addition, the pattern 300 includes a ceramic strongback core 310 having a surface 312 contacting a leading edge region of the pattern airfoil 314. The exemplary strongback core 310 may be molded over the RMC 302 in the same molding step as is the core 304. Although the leading edge of the RMC protrudes from the exemplary strongback core 310, flush and subflush (e.g., embedded) variations are possible.

FIG. 18 also shows suction and pressure side RMCs 320 and 322. In an exemplary implementation, after the overmolding of the cores 304 and 310, the RMCs 320 and 322 are assembled/secured to the core subassembly. One or both of the cores 304 and 310 may be molded with rebates or other features for receiving adjacent portions of the RMCs 320 and 322.

In the wax molding process, the surface 312 of the strongback core 310 effectively forms a portion of the wax die. After application of the shell 330 and subsequent dewaxing, the surface 312 forms a portion of the casting cavity along the airfoil exterior contour. In this way, the role of a strongback core in forming an exterior contour is distinguished from use in forming an interior surface.

Figure 19:
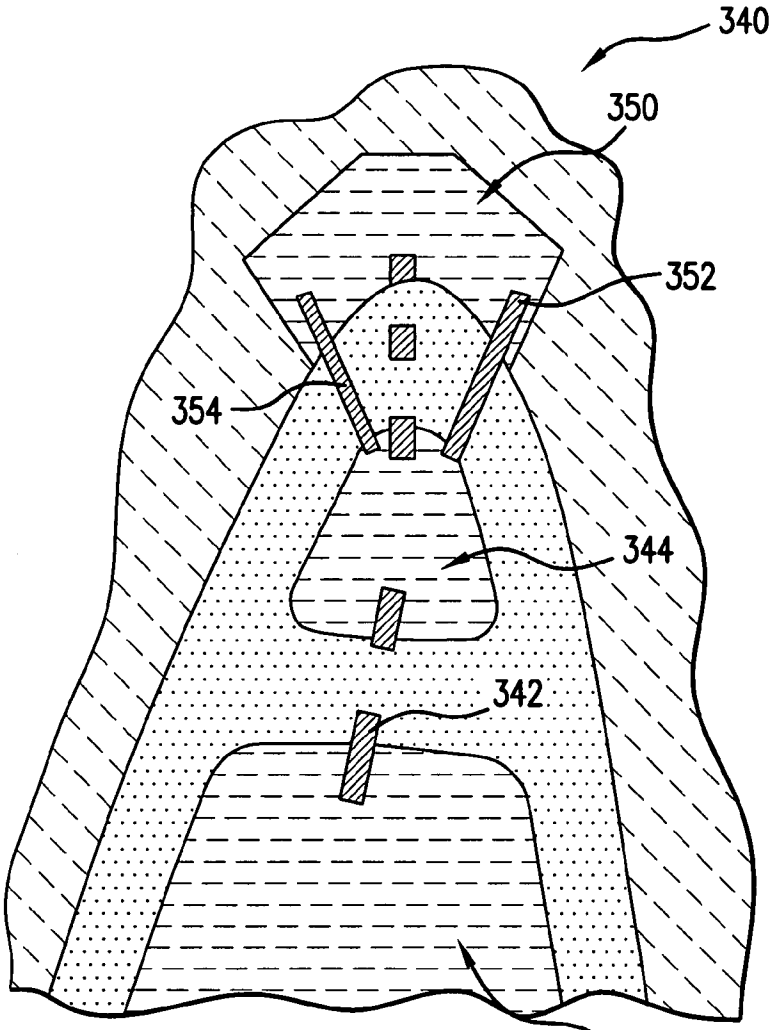
FIG. 19 is a sectional view of another alternate shelled pattern.

FIG. 19 shows another variation on a shelled pattern 340 including an RMC 342, an impingement cavity core 344, and a feedcore 346. A strongback core 350 is assembled to the RMC 342 after the core 344 is molded over the RMC 342. The exemplary strongback core 350 may, itself, be initially molded over suction and pressure side RMCs 352 and 354. The assembly of the strongback core 350 to the RMC 342 may also assemble/secure adjacent portions of the RMCs 352 and 354 to the core 344.

One or more embodiments of the present invention have been described. Nevertheless, it will be understood that various modifications may be made without departing from the spirit and scope of the invention. For example, the principles may be implemented using modifications of various existing or yet-developed processes, apparatus, or resulting cast article structures (e.g., in a reengineering of a baseline cast article to modify cooling passageway configuration). In any such implementation, details of the baseline process, apparatus, or article may influence details of the particular implementation. Accordingly, other embodiments are within the scope of the following claims.

What is claimed is:

1. A method comprising:

forming a core assembly, the forming including:

molding a first ceramic core over a first refractory metal core to form a core subassembly; and assembling the subassembly to a second ceramic core.

2. The method of claim 1 wherein:

the assembling comprises mounting an edge portion of the refractory metal core in a slot of the second ceramic core.

3. The method of claim 1 wherein the forming includes:

cutting the refractory metal core from sheetstock, the cutting comprising at least one of laser cutting, electrodischarge machining, liquid jet cutting, and stamping.

4. The method of claim 1 wherein the forming includes:

bending the refractory metal core from a planar to an arcuate form.

5. The method of claim 1 wherein the molding comprises:

molding a plurality of individual protuberances on each of a plurality of legs of the refractory metal core.

6. The method of claim 1 further comprising:

coating the refractory metal core.

7. The method of claim 1 further comprising:

molding a third ceramic core over the refractory metal core.

8. The method of claim 7 wherein:

the third ceramic core is molded after the first ceramic core is molded.

9. The method of claim 1 wherein:

the molding fills an array of apertures in the refractory metal core.

10. The method of claim 1 wherein:

the molding comprises freeze casting.

11. The method of claim 1 further comprising:

molding a pattern-forming material at least partially over the core assembly for forming a pattern;

shelling the pattern;

removing the pattern-forming material from the shelled pattern for forming a shell;

introducing molten alloy to the shell; and removing the shell and core assembly.

12. The method of claim 11 used to form a gas turbine engine component.

13. The method of claim 11 used to form a gas turbine engine airfoil wherein the first ceramic core casts a leading edge cavity.

14. The method of claim 13 wherein:

the leading edge cavity is an impingement cavity;

first legs of the refractory metal core cast outlet passageways from the impingement cavity to an outer surface of the airfoil; and second legs of the refractory metal core cast impingement feed passageways between the impingement cavity and a feed passageway cast by the second ceramic core.

15. An investment casting method comprising:

providing a casting core combination comprising:

a first metallic casting core;

a ceramic feedcore in which a first portion of the first metallic casting core is embedded; and a leading edge ceramic strongback core in which a second portion of the first metallic casting core is embedded;

molding a wax material at least partially over the first metallic casting core and the feedcore and having:

an airfoil contour surface including:

a leading edge portion along a first surface portion of the strongback core; and pressure and suction side portions extending from the leading edge portion clear of the strongback core;

applying a stucco at least partially over the strongback core wax material; and removing the wax material to leave a cavity;

casting an alloy in the cavity; and removing the stucco, first metallic casting core, feedcore, and strongback core.

16. The method of claim 15 wherein the providing comprises:

molding the strongback core over the first metallic casting core.

17. An investment casting core combination comprising:

a first metallic casting core;

a ceramic feedcore in which a first portion of the first metallic casting core is embedded; and a leading edge ceramic strongback core in which a second portion of the first metallic casting core is embedded.

18. The investment casting core combination of claim 17 further comprising:

a ceramic core molded to the first metallic casting core between the feedcore and strongback core;

a second metallic casting core spanning between the ceramic core and strongback core on a first side of the first metallic casting core; and a third metallic casting core spanning between the ceramic core and strongback core on a second side of the first metallic casting core.

19. An investment casting pattern comprising:

the investment casting core combination of claim 17; and a wax material at least partially encapsulating the first metallic casting core and the feedcore and having:

an airfoil contour surface including:

a leading edge portion along a first surface portion of the strongback core; and pressure and suction side portions extending from the leading edge portion clear of the strongback core.

20. An investment casting shell comprising:

the investment casting core combination of claim 17; and a ceramic stucco at least partially encapsulating the strongback core and the feedcore; and an airfoil contour interior surface including:

a leading edge portion formed by a first surface portion of the strongback core; and pressure and suction side portions extending from the leading edge portion and formed by the ceramic stucco.

* * * * *